US006640928B1

(12) United States Patent
Ridley, Jr.

(10) Patent No.: US 6,640,928 B1
(45) Date of Patent: Nov. 4, 2003

(54) FREE-STANDING, MULTI-FUNCTIONAL, MOBILE CONSTRUCTION AID

(76) Inventor: Hal J. Ridley, Jr., 3347 Tootie Rd., Orange, TX (US) 77630

( * ) Notice: Subject to any disclaimer, the term of this patent is extended or adjusted under 35 U.S.C. 154(b) by 0 days.

(21) Appl. No.: 10/058,617

(22) Filed: Jan. 28, 2002

Related U.S. Application Data

(63) Continuation of application No. 09/515,546, filed on Feb. 29, 2000, now abandoned.

(51) Int. Cl.[7] ..... E06C 1/00

(52) U.S. Cl. ..... 182/68.1; 182/66.2; 182/69.4; 182/208

(58) Field of Search ..... 182/68.1, 69.4, 182/66.2, 208, 67.3

(56) References Cited

U.S. PATENT DOCUMENTS 235,255 A * 12/1880 King ..... 182/68.1 X
362,609 A * 5/1887 Clator ..... 182/68.1 X
670,548 A * 3/1901 Sliger ..... 182/68.1 X
719,364 A * 1/1903 Pettis ..... 182/68.1 X
3,515,243 A * 6/1970 Ellen, Jr. ..... 182/68.1 X
4,054,182 A * 10/1977 Ide ..... 182/68.1
4,335,803 A * 6/1982 Sugita ..... 182/12
4,366,591 A * 1/1983 Zimmerman ..... 14/71.3
4,427,093 A * 1/1984 Wehmeyer et al. ..... 181/141
5,111,907 A * 5/1992 Kishi ..... 182/63
6,347,684 B1 * 2/2002 Fath et al. ..... 182/63.1

* cited by examiner

*Primary Examiner*—Bruce A. Lev
(74) *Attorney, Agent, or Firm*—Williams, Morgan & Amerson, P.C.

(57) ABSTRACT

A lightweight, multifunctional, robotic construction aid capable of replacing heavy, dangerous, conventional construction equipment including cranes, manlifts, scissorlifts, scaffolds, and extension ladders. More particularly, the apparatus comprises a base, a lower ladder portion, an upper ladder portion, and a support. The lower ladder portion is pivotably connected to the base and extends therefrom in a first direction. The upper ladder portion is pivotably connected to the lower ladder portion and extends therefrom in a second direction opposite the first direction and includes an access therethrough from the lower ladder portion. The support is capable of bearing the weight of the first and second ladder portions and of fixing the relative positions of the upper ladder portion, the lower ladder portion, and the base.

48 Claims, 13 Drawing Sheets

FREE-STANDING, MULTI-FUNCTIONAL, MOBILE CONSTRUCTION AID

This is a continuation of application Ser. No. 09/515,546 filed Feb. 29, 2000 now abandoned.

BACKGROUND OF THE INVENTION

1. Field of the Invention

This application relates generally to construction equipment and, more particularly, to a versatile piece of construction equipment capable of performing a number of functions valuable at a construction site.

2. Description of the Related Art

The construction site is a very demanding work environment. Time is almost always a factor in every job, and there is usually a lot of pressure to meet certain schedules so that a construction project is finished "on time." Efficient operation and organization of tasks and crew is therefore very important. However, no matter how efficiently organized, there is always a certain amount of otherwise productive time wasted for a variety of reasons.

One reason is the poor utility, availability and/or accessibility of equipment. Each piece of equipment is usually designed for one specific task. Consequently, as the construction continues, equipment must be switched out as tasks are completed and new tasks are begun. One may, for instance, need to break down a crane used to unload materials and retrieve a forklift to move materials to a desired point on the construction site. Such concerns might even be as mundane as a worker having to retrieve a tool stored in a vehicle at the edge of the site. Although each of these incidents is necessary and, in itself, consumes little time, they cumulatively consume a great deal of time that is not actually devoted to the construction project itself. The more workers there are, the greater this cumulative time loss becomes.

The construction site is also very dangerous. Many workers are typically found on a construction site, each of which is focused on the specific task to which they are assigned. If the proper tool or equipment is not handy, a worker may use a tool poorly suited or improperly deployed for a given task, and get injured. The more workers involved and the more inaccessible the tools are, the more likely this is to happen. Sometimes workers are simply too focused on their specific task and are unaware of unsafe conditions or events occurring around them. Again, the more workers on a given site, the more likely this is to happen. Thus, the number of workers and the convenient location of tools are significant factors that affect construction site safety.

The present invention is directed to resolving one or all of the problems mentioned above.

SUMMARY OF THE INVENTION

The invention is, in its various aspects and embodiments, a lightweight, multifunctional, construction aid capable of replacing heavy, dangerous, conventional construction equipment including cranes, manlifts, scissorlifts, scaffolds, and extension ladders. More particularly, the apparatus comprises a base, a lower ladder portion, an upper ladder portion, and a support. The lower ladder portion is pivotably connected to the base and extends therefrom in a first direction. The upper ladder portion is pivotably connected to the lower ladder portion and extends therefrom in a second direction opposite the first direction and includes an access therethrough from the lower ladder portion. The support is capable of bearing the weight of the upper and lower ladder portions and of fixing the relative positions of the upper ladder portion, the lower ladder portion, and the base.

BRIEF DESCRIPTION OF THE DRAWINGS

The invention may be understood by reference to the following description taken in conjunction with the accompanying drawings, in which like reference numerals identify like elements, and in which.

Figure 1:
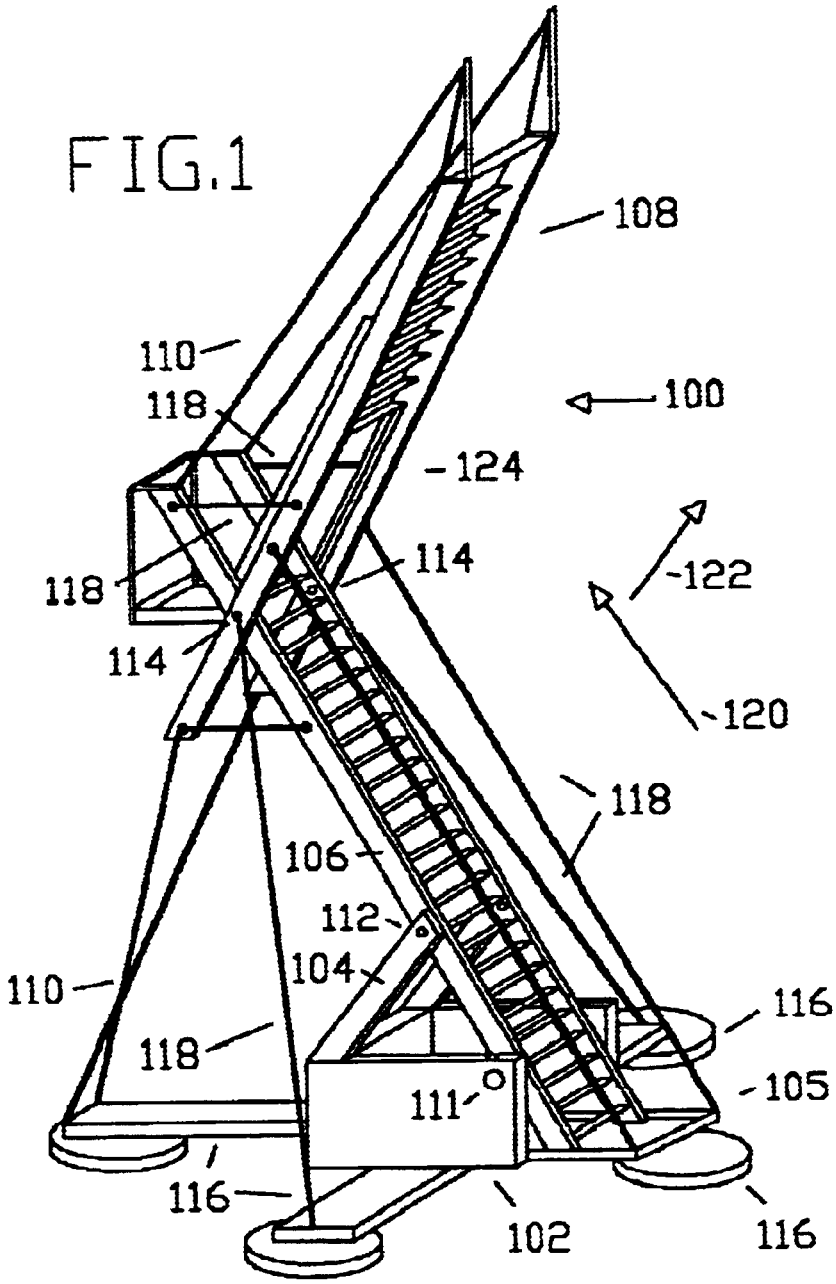
FIG. 1 is an isometric view of one embodiment of an extension ladder constructed in accordance with the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will be appreciated that, in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Turning now to the drawings, FIG. 1 illustrates one particular embodiment of an extension ladder 100 constructed in accordance with the present invention. The extension ladder 100 generally comprises a base 102; a pair of struts 104; a lower ladder portion 106; and an upper ladder portion 108. The extension ladder 100 also includes a plurality of cables 110 capable of offsetting the torque generated by gravity operating on the center of gravity for the upper ladder portion around the pair of pivots 114 by which the lower and upper ladder portions 106, 108 are pivotably joined. In the embodiment of FIG. 1, these cables 110 also fixing the relative positions of the upper ladder portion 108, the lower ladder portion 106, and the base 102. The struts 104 are connected extend from the base 102 and are pivotably connected to the lower ladder potion 106 at the pivots 112. In some embodiments, the struts may be pivotably joined to the base. The lower ladder portion 106 is also pivotably joined to the base 102 at a pair of pivots 111. The base 102, in this particular embodiment, includes a guide 105. The guide 105 constrains the movement of the lower ladder portion 106 about the first and second pair of pivots 112, 111. However, some alternative embodiments may omit the guide 105.

The upper ladder portion 108 includes an access 124 therethrough from the lower ladder portion 106. The access 124 may be a simple opening in some embodiments. Note that the size of the opening will be implementation specific. The opening for the access 124 must be large-enough for a worker and equipment to pass through, but not so large it impedes the worker's ascent of the upper ladder portion 108.

Figure 2:
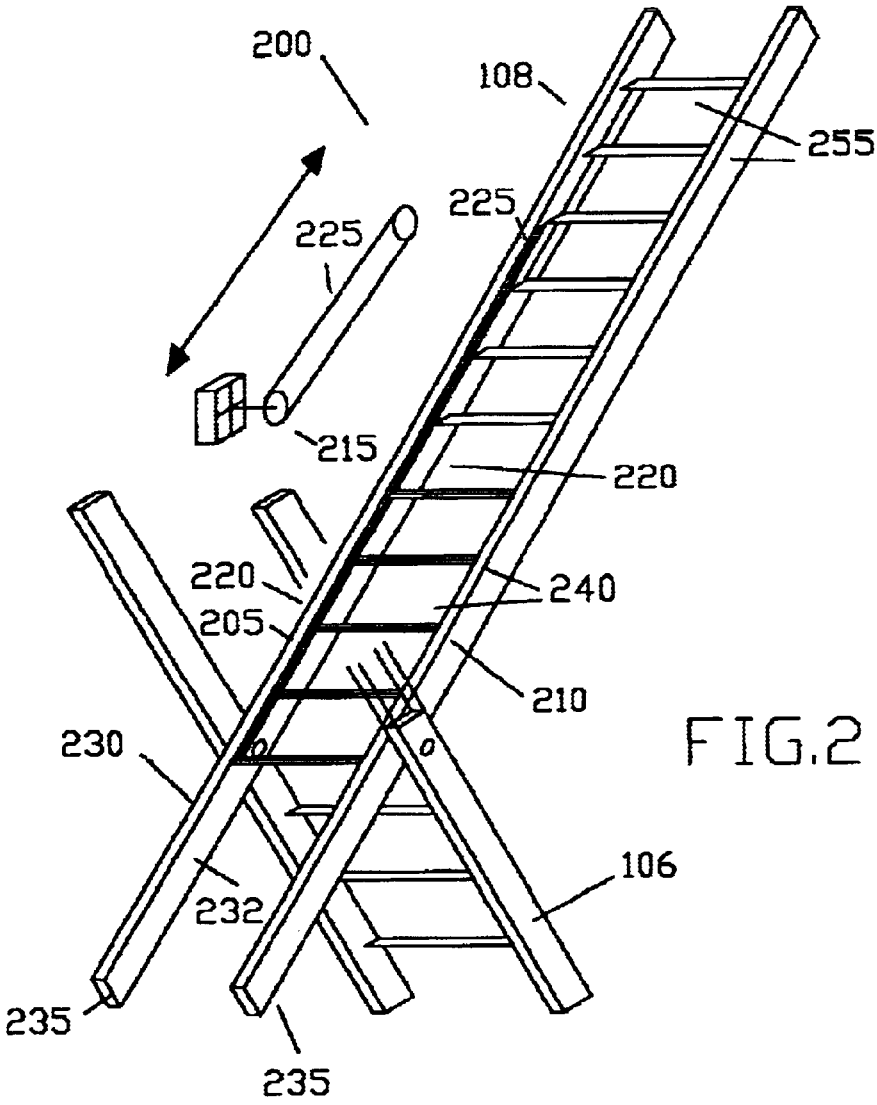
FIG. 2 details the access from the lower ladder portion to the upper ladder portion of the embodiment in FIG. 1.

However, other embodiments, such as the one illustrated in FIG. 1, may include more elaborate means for providing access from the lower portion 106 to the upper portion 108. FIG. 2 details one particular embodiment 200 of the access 124 in FIG. 1. In this embodiment, a removable door 205 covers an opening 210. The removable door 205 includes a plurality of rollers 215 on either side 220 of the removable door 205. The rollers are fitted into a track 225 mounted on, formed in, or defined by the top surface 230 of the risers 235 of the upper ladder portion 108. A worker climbs the lower portion 106 until he reaches the access 124, raises the removable door 205, and climbs the lower portion 106 until he is through the access 124, holding the removable door 205 open. Once through, the worker releases the removable door 205, which closes by operation of gravity, and climbs the upper portion 108. In the embodiment illustrated, the removable door 205 includes a plurality of treads 240 to facilitate the worker's ascent of the upper ladder portion 108 over the removable door 205. The treads 240 are spaced roughly the same as the treads 255 of the upper ladder portion 108.

Returning to FIG. 1, in the illustrated embodiment, the base 102 includes a plurality of outriggers 116 extending radially. Note that, in this embodiment, the cables 110 include a plurality of guys 118 running between the outriggers 116 and various points on the lower and upper ladder portions 106, 108. Four guys 118 are shown, but the number will be implementation specific. Similarly, the number of outriggers 116, where employed, will be implementation specific. Three outriggers 116, for instance, would be sufficient for some embodiments. However, four outriggers 116 provide excellent support via the guys 118 for the lower and upper ladder portions 106, 108 and excellent stability. Note also that each of the outriggers 116 in the illustrated embodiments includes a foot 119 to provide additional stabilization, although these may be omitted in some embodiments.

The extension ladder 100 is shown erected in FIG. 1. Note that the lower ladder portion 106 extends in a first direction, represented by the arrow 120, and the upper ladder portion 108 extends in a second direction, represented by the arrow 122. The second direction 122 is opposite the first direction 120. Extending the lower and upper ladder portions 106, 108 in opposite directions permits the lower and upper portions 106, 108 to position the worker over the approximate center of gravity of the extension ladder 100. Note also that the guys 118 are taut, because of the forces encountered in their support function and in fixing the relative positions of the upper ladder portion 108, lower ladder portion 106, and base 102.

FIGS. 3A–3E illustrate one particular embodiment 300 for the base 102 in FIG. 1 in sectioned side, top, and rear plan views, respectively. In this particular embodiment, the base 300 includes a housing 302 (which may be omitted in some implementations) on a platform 304. The housing 302 encloses a space 306 and is open at the top 308. The base 300 houses an engine 310 that, in this particular embodiment, powers a plurality of wheels 312 and drives a hydraulic system comprising a hydraulic gear box 314 and a plurality of hydraulic pistons 316*a*–316*d*. In one particular implementation, the engine 310 is a 40 Hp diesel engine. The base 300 also includes a plurality of jointed outriggers 116*a*, only two of which are shown in any given view, that are pivotably mounted to the base 300 and articulate to extend radially outward. Note that this differs from the embodiment of the base 102 shown in FIG. 1. The base 102 in FIG. 1 includes outriggers 116 that are not jointed. Returning to FIGS. 3A–3C, the base 300 also includes a compressor (not shown) in this particular implementation.

The hydraulic system adds several useful options to the extension ladder 100 of FIG. 1. The wheels 312, in this implementation, retract into the base 300 by operation of the hydraulic pistons 316*b*–316*d* through the hydraulic gear box 314. The hydraulic piston 316*a* lifts the lower and upper ladder portions 106, 108 through the hydraulic gear box 314 and an auxiliary hydraulic system. Although the auxiliary hydraulic system is not shown, its implementation will become apparent to those skilled in the art having the benefit of this disclosure. The hydraulic system may also articulate the jointed outriggers 116*a* from the slots 320 in the platform 304 to extend them and then to return them to the slots 320.

The engine 310 and the hydraulic system (i.e., the hydraulic gear box 314 and hydraulic pistons 316*a*–316*d*) consequently provide embodiments of the extension ladder 100 employing the base 300 with a useful mobility. The extension ladder 100 may be transported to a work site and unloaded in conventional fashion. Once unloaded, the engine 310 can be started to drive the hydraulic system, which can then be used to lower the wheels 312 from the base 300. Using a steering mechanism not shown, the engine 310 is then operated to drive the extension ladder 100 to the place on the site at which it is to be used. The outriggers 116*a* are then extended, the wheels 112 retracted into the base 300, and the upper and lower portions 108, 106 raised. Once the upper and lower portions 108, 106 are raised, the cables 110 are placed. The engine 310 may then be turned off or, if desired, left on to power the compressor 318. The process may be reversed to move the extension ladder 100 to a new location.

Note, however, that the invention does not require this mobility in all embodiments. Some embodiments may omit the engine 310 and the hydraulic system. These embodiments may exhibit wide variation, including, but not limited to:

- slots (not shown) in the platform 304 in the manner of a wooden pallet, so that the extension ladder 100 may be moved by, for instance, a forklift;
- the wheels 312 not being retractable, and being mechanically held once the extension ladder 100 is positioned;

a hand crank by which the lower and upper ladder portions 106, 108 may be raised or by which the outriggers 116, 116*a* may be extended; and "permanently" extended lower and upper ladder portions 106, 108 that do not collapse and, consequently, do not need to be raised.

However, the mobility exhibits great utility in the construction site by, among other things, not requiring additional equipment to move.

Figure 3B:
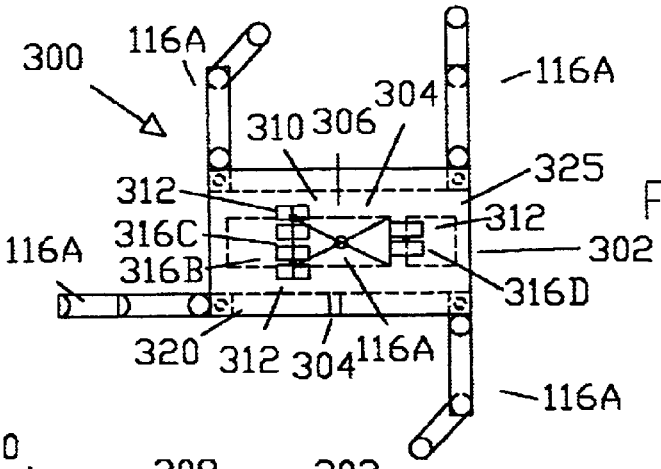
FIGS. 3A–3E illustrate one particular embodiment of the base for the extension ladder in FIG. 1.
Figure 3A:
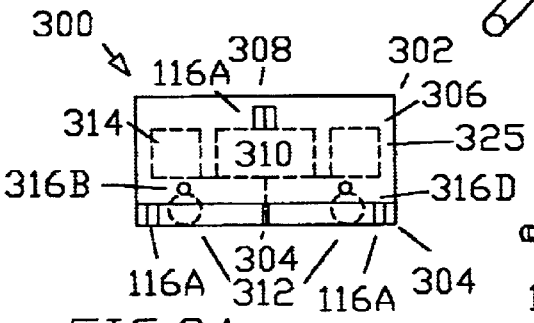
Figure 3C:
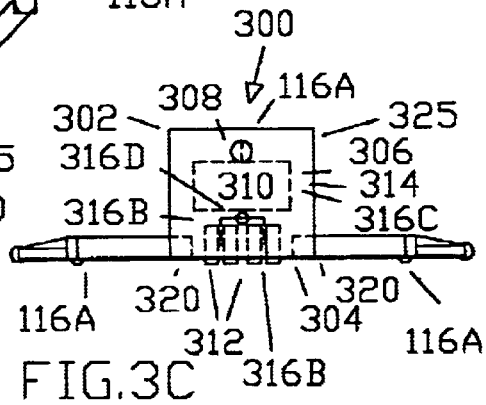
Figure 3D:
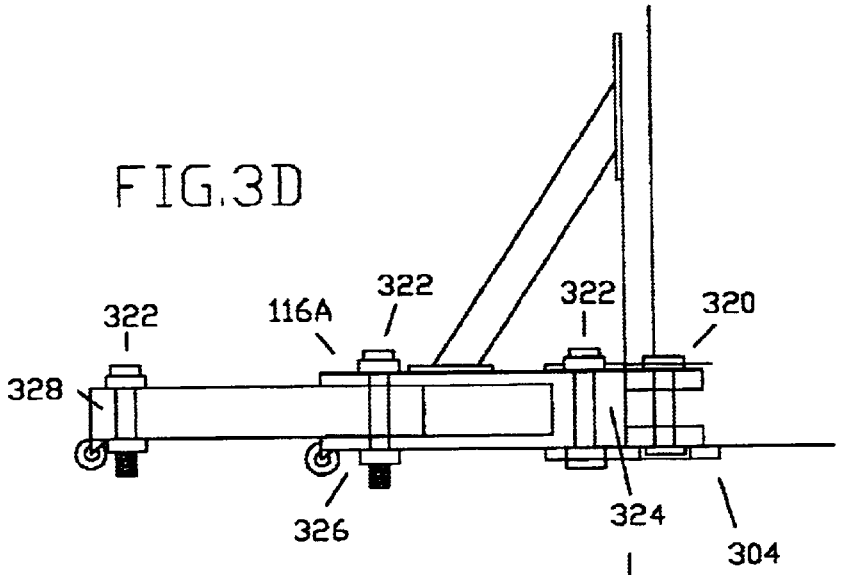
Figure 3E:
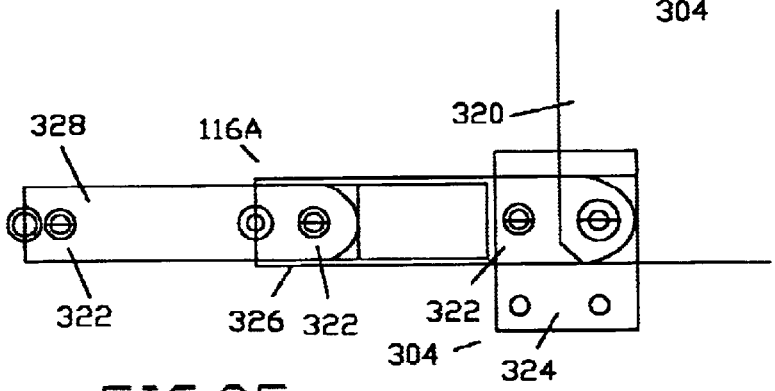

In the particular embodiment illustrated, however, the housing 302 and platform 304 also define a rectangular steel tool box approximately 8 ft.×4 ft.×4 ft. (_m×_m×_m) in size. The housing 302 and platform 304 are made of welded steel plate and angle. Certain features of the outriggers 116*a* are best shown in FIGS. 3D–3E. Although the outriggers 116 in FIG. 1 are solid, one-piece members, each outrigger 116*a* in FIGS. 3A–3C is a two part member extending at 90° from the platform 304 and swiveling. Each outrigger 116*a* includes three screw down locking devices 322, one each at the comer 324, the middle 326, and at the end 328 of the outrigger 116*a*, for mounting screw down or to hold removable counterweight system.

Various embodiments of the extension ladder 100 may also be combined or modified with alternative capabilities to provide additional utility on a worksite. For instance, a variety of hoisting frames can be attached to the ladders in different configurations allowing the unloading of material from the truck, raising and erecting the steel, loading material to the roof structure, etc. The extension ladder 100 may also be able to have an integrated automatic rising basket system.

Figure 4:
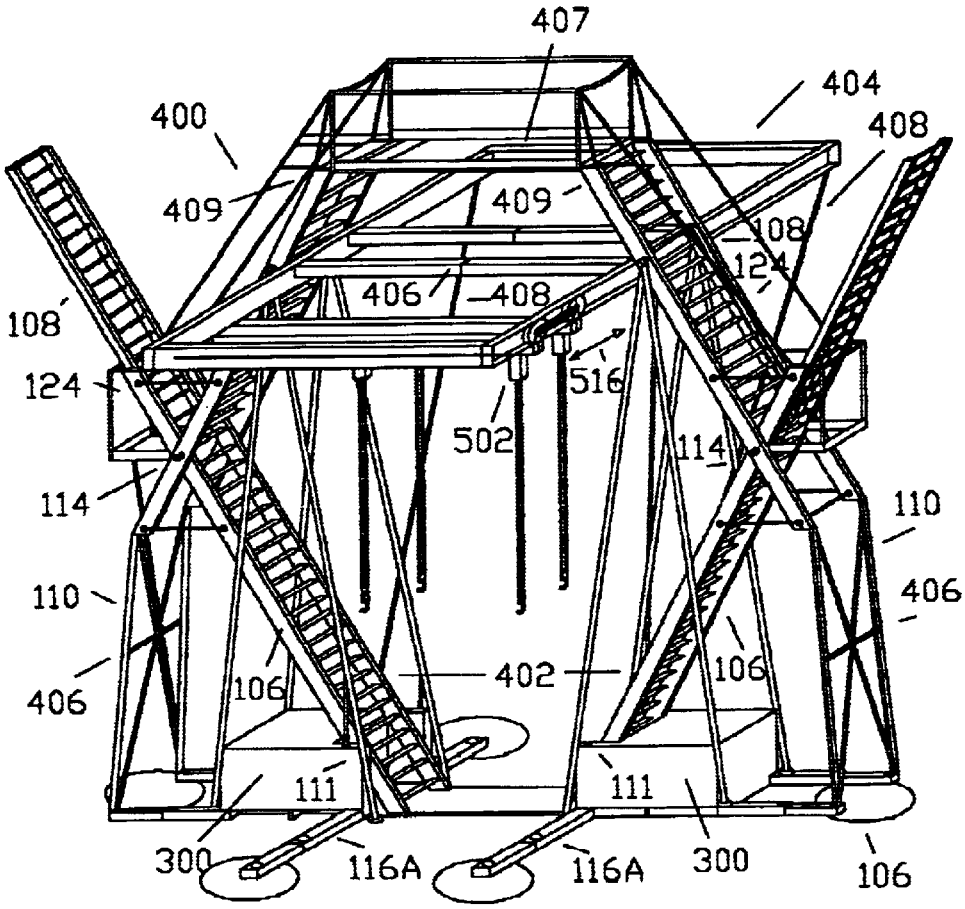
FIG. 4 depicts a gantry crane implemented with an embodiment of an extension ladder alternative to that in FIG. 1.

FIG. 4 illustrates how one such variant embodiment may be used to implement a gantry crane 400. The gantry crane 400 generally comprises two facing extension ladders 402 supporting a crane section 404. Each extension ladder 402 includes a base 102, a plurality of outriggers 116, a lower ladder portion 106, and an upper ladder portion 108 having an access 124 therethrough. Note, however, that the support 110 comprises a pair of braces 406 extending from one of the outriggers 116 to the pivots 114. The braces 406 replace the struts 104 in the embodiment of FIG. 1. Note also that the crane section 404 is supported and stabilized in this particular embodiment by a plurality of guys 408 running upwardly from the outriggers 116.

Figure 5A:
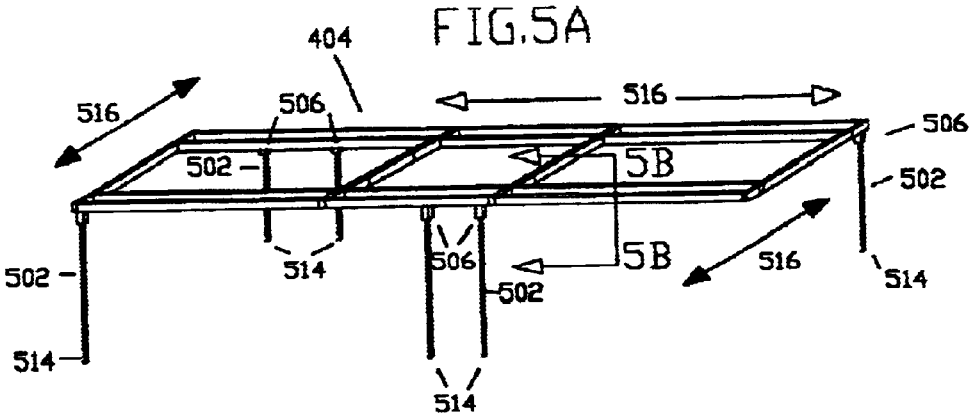
FIGS. 5A–5B illustrate the crane section of the gantry crane in FIG. 4 in an isometric, side view and a sectional view of a block and tackle and a track 504 along line 5B—5B in FIG. 5A, respectively.
Figure 5B:
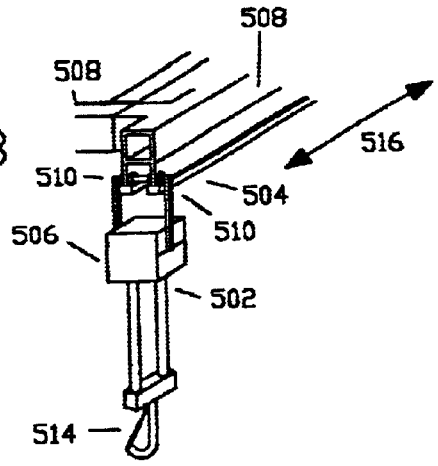

FIGS. 5A–5B illustrate the crane section 404 in greater detail. FIG. 5A is an isometric, side view of the crane section 404, which generally comprises a plurality of block and tackles 502 moving along a pair of tracks 504. FIG. 5B is a sectional view of a block and tackle 502 and a track 504 along line 5B—5B in FIG. 5A. As shown in FIG. 5B, the block 506 translates along the rail 508 of the track 506 on a pair of opposed wheels 510 rotatably mounted to a spindle 512. The block 506 and tackle 514 (in FIG. 5A) are suspended from the track 506 by the spindle 512. Each block and tackle 502 traverses the rails 504 in the direction of the arrow 516, shown also in FIG. 4.

Returning to FIG. 4, the gantry crane 400 may be assembled by first positioning the extension ladders 402 facing each other, as shown. The extension ladders 402 are collapsed. The crane section 404 is fastened to the upper ladder portions 108 of the extension ladders 402. In one implementation, the crane section 404 is fastened using nuts and bolts (not shown) threaded through co-aligned holes (also not shown) in the crane section and the upper ladder portions 108. Note that the upper ladder portions 108 are pivotably connected to the brace 407 by the pivots 409 to permit relative movement as the extension ladders 402 are raised and lowered.

Each of the extension ladders 402 is implemented using the base 300 of FIGS. 3A–3C, and so provides power to the gantry crane 400 accordingly. The extension ladders 402, with the crane section 404 fastened thereto, are then raised using the power provided by the base 300. Once the extension ladders 402 are raised, the supports 110 are placed. Note that, in this particular embodiment, the weight of the crane section 404 loads the supports 110. The block and tackles 502 can then traverse the crane section 404 powered by the base 300. The base 300 also includes a winch (not shown) by which the block and tackles 502 may raise various loads.

Figure 6:
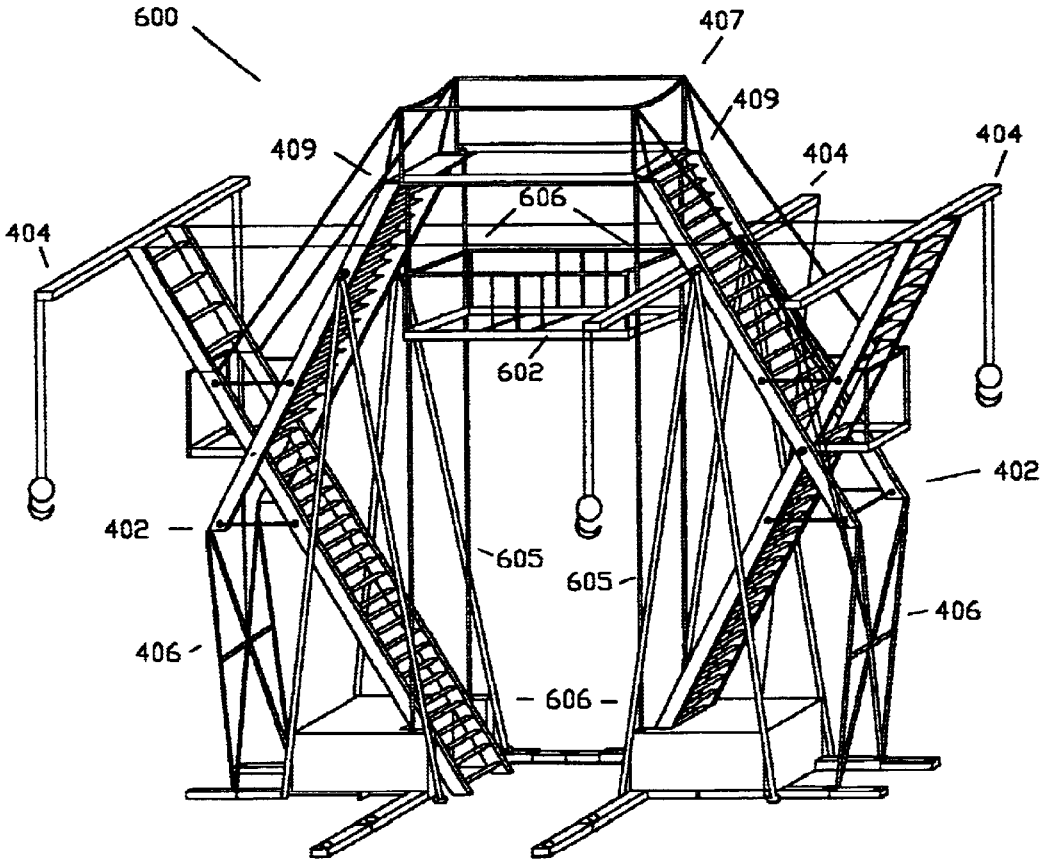
FIG. 6 depicts a man-lift implemented with the embodiment of the extension ladder in FIG. 4.

FIG. 6 illustrates an alternative implementation 600 in which the crane section 404 is displaced by a lift including a personnel basket 602 suspended between the two extension ladders 402. The personnel basket 602 in the particular implementation 600 illustrated may carry people, as well as equipment and supplies. Eight motors (not shown) are attached to the comers 606 of the personnel basket 602. The motors can lift the basket 602 up two tracks (not shown) along the risers 605.

Note that the implementation 600 includes multiple crane sections 404 such as are described above. One of the crane sections 404 structurally joins the two upper ladder portions 108 as in the gantry crane 400 in FIG. 4. However, two of the crane sections 404 are fastened to only a single one of the lower ladder portions 106 and the upper ladder portions 108, as opposed to being suspended between the two extension ladders 402 from the brace 409. One or all of the crane sections 402 may be omitted in various alternative implementations.

The invention in its various aspects may also include a variety of screw down mounting systems, e.g., the screw downs 322 in FIGS. 3D–3E, as well as a removable counterweight system (not shown), whichever is needed at any given time. The screw down system may mount into prepoured receptacles (not shown) within a slab (not shown). The base 102 may comprise a mobile toolbox 325, as shown in FIGS. 3A–3C, acting as a counterweight. Welding leads, hoses, power cords, etc. can run in cable trays along either of the ladder portions 106, 108. If so, they may be secured, readily available for visual inspection, and properly placed, thereby eliminating the need to roll out or roll up this equipment.

Figure 7A:
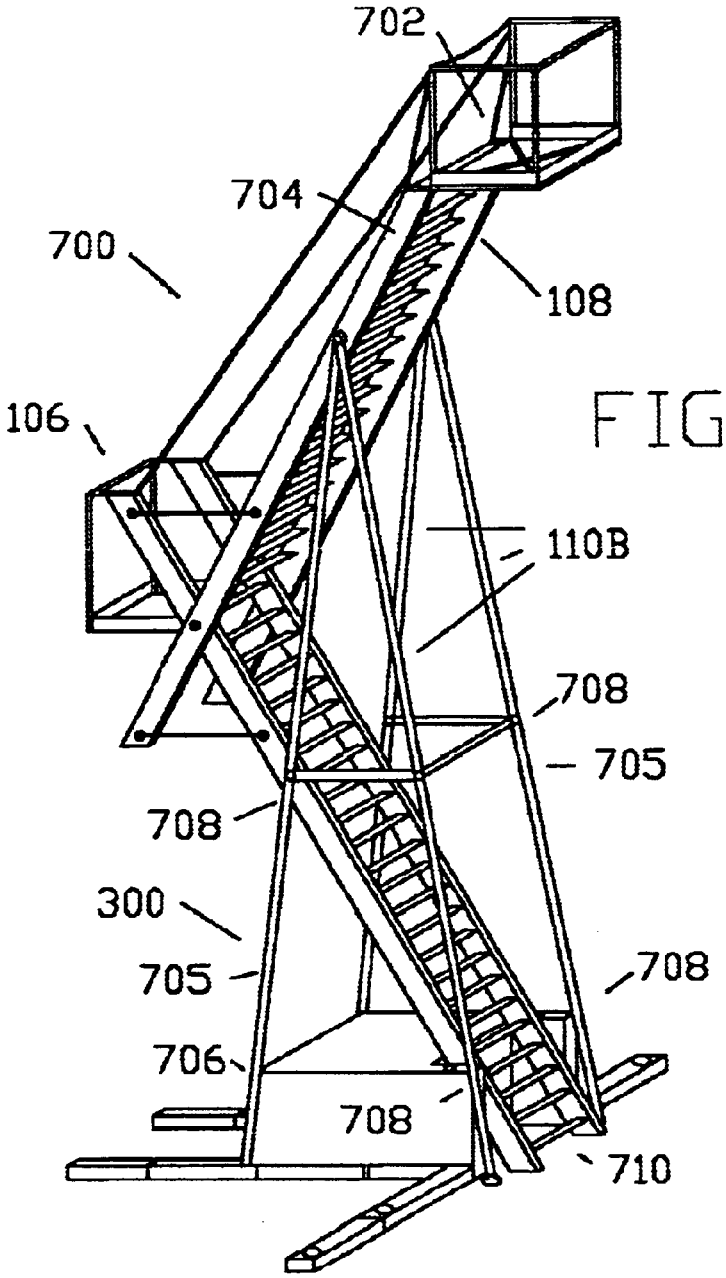
FIGS. 7A–7C illustrate a third particular embodiment of an extension ladder alternative to that in FIG. 1 and built in accordance with the present invention.
Figure 7B:
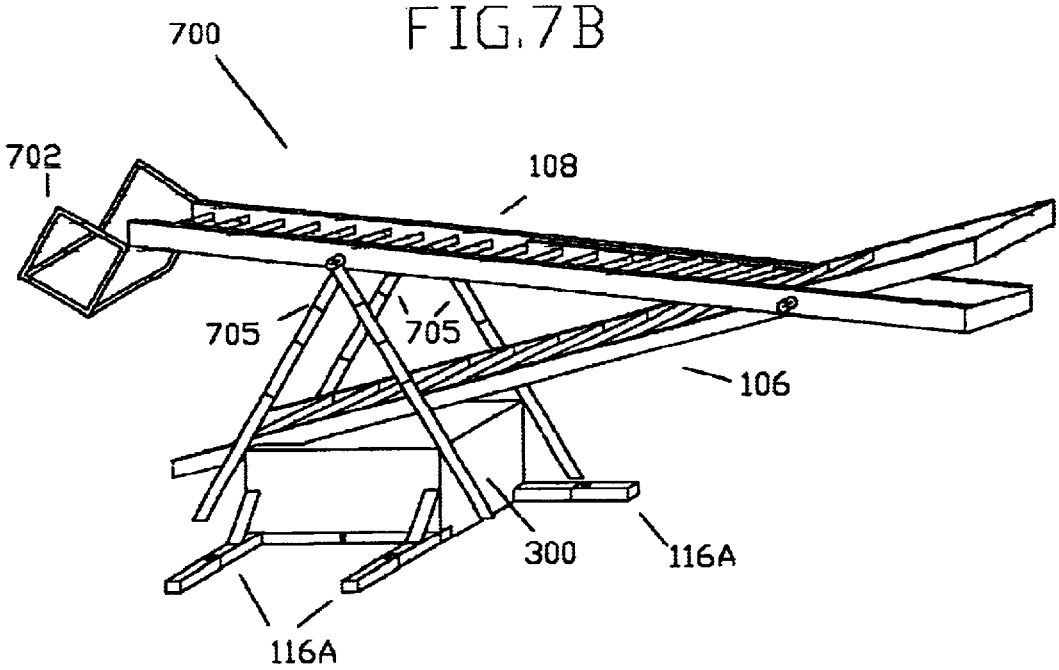
Figure 7C:
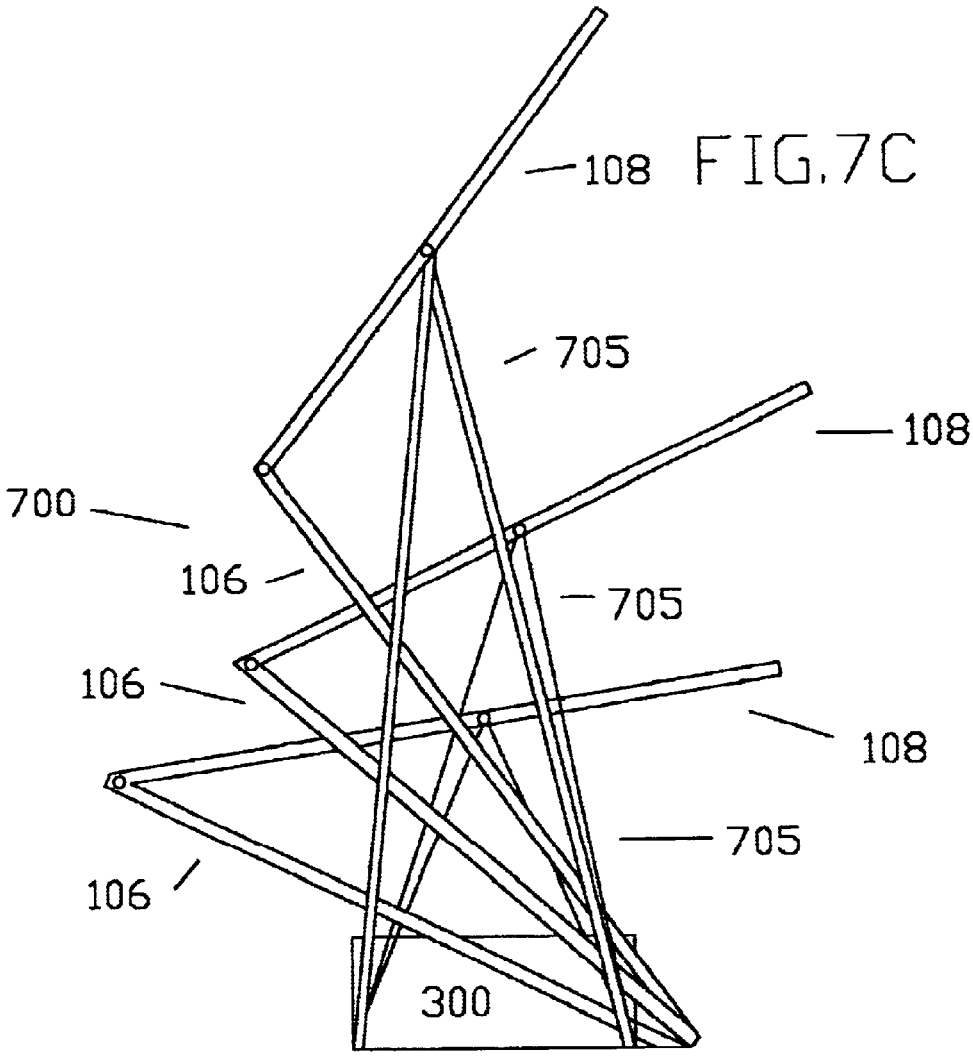

FIGS. 7A–7C illustrate a second particular embodiment 700. The extension ladder 700 is an embodiment alternative to that in FIG. 1 and built in accordance with the present invention. The extension ladder 700 includes a base 300 such as is shown in FIGS. 3A–3E and discussed above. The extension ladder 700 also includes an enclosed platform, or "man basket," 702 affixed to the uppermost end 704 of the upper ladder portion 108. However, the support 110*b* comprises four gin poles 705, instead of the guy wires in FIG. 1 or the braces in FIG. 4. The supports 110*b* may be used to lift the extension ladder 700 from its collapsed position, shown in FIG. 7B, to its raised position, shown in FIG. 7A, and then to collapse it again. The relative positions of the lower ladder portion 106, upper ladder portion 108, and the support 110*b* as the extension ladder is moved from position to the other is shown in FIG. 7C.

More particularly, the four gin poles 705 are pinned at each upper comer 706 of the toolbox 325 with a swiveling base 300. The gin poles 705 are fabricated in three parts and extend in an A-frame type fashion to lift the lower and upper ladder portions 106, 108. The lower and upper ladder portions 106, 108 are cross-braced by the braces 708. The lower and upper ladder portions 106, 108 comprise two 20-foot extension ladders of welded tubular steel atop each other. The lower ladder portion 106 is pinned three feet past the end of the toolbox 325, i.e., three feet from the foot 710 of the lower ladder portion 106. The upper ladder portion 108 is pinned to the lower ladder portion 106 at the other end, four feet from the top. As mentioned, the upper and lower ladder portions 106, 108 are lifted into place by the gin poles 705 and pinned in position.

Because of the elbow-shaped configuration of the lower and upper ladder portions 106 and 108, the fully extended manbasket 702 is 30 feet high and is very near the center of gravity, which stabilizes the ladder 100, 700. The toolbox 325 and equipment it might store (not shown) add further stability, acting as a counterweight. The access 124 through the upper extension ladder 108 includes a five-foot sliding removable door 205, discussed more fully above, at its bottom with spring weight and pins. A worker climbs the lower ladder portion 106, passes through the removable door 205 at the bottom of the upper ladder portion 108, slides the door 205 closed, and continues to the top of the upper ladder portion 108.

Figure 8:
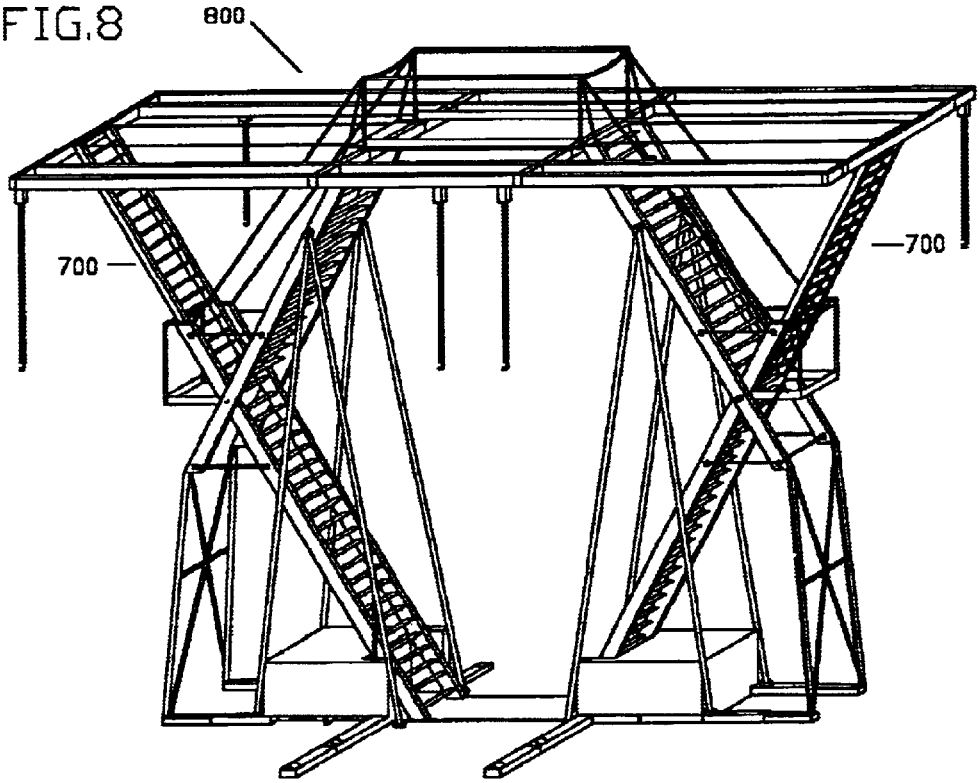
FIG. 8 depicts a man-lift similar to that in FIG. 6, but implemented with the extension ladder of FIGS. 7A–7C.

FIG. 8 illustrates how two of the extension ladders 700 in FIGS. 7A–7C may be configured to implement a man-lift 800. The man lift 800 is similar in structure and operation to the man lift 600 in FIG. 6, except it employs the extension ladders 700 instead of the extension ladders 100. The extension ladders 700 may also be configured to implement a gantry crane (not shown) such as the gantry crane 400 in FIG. 4. Two mobile, freestanding ladders 700 are pinned together to make up the base structure. A man lift system may be pinned within the base structure. Alternatively, an external extending-retracting twin gantry crane (not shown) system may be fastened to the base structure. The twin gantry crane can be used to off-load material from a truck, move such materials, load them onto a roof structure, and/or erect structural steel members, columns, and beams.

Figure 9:
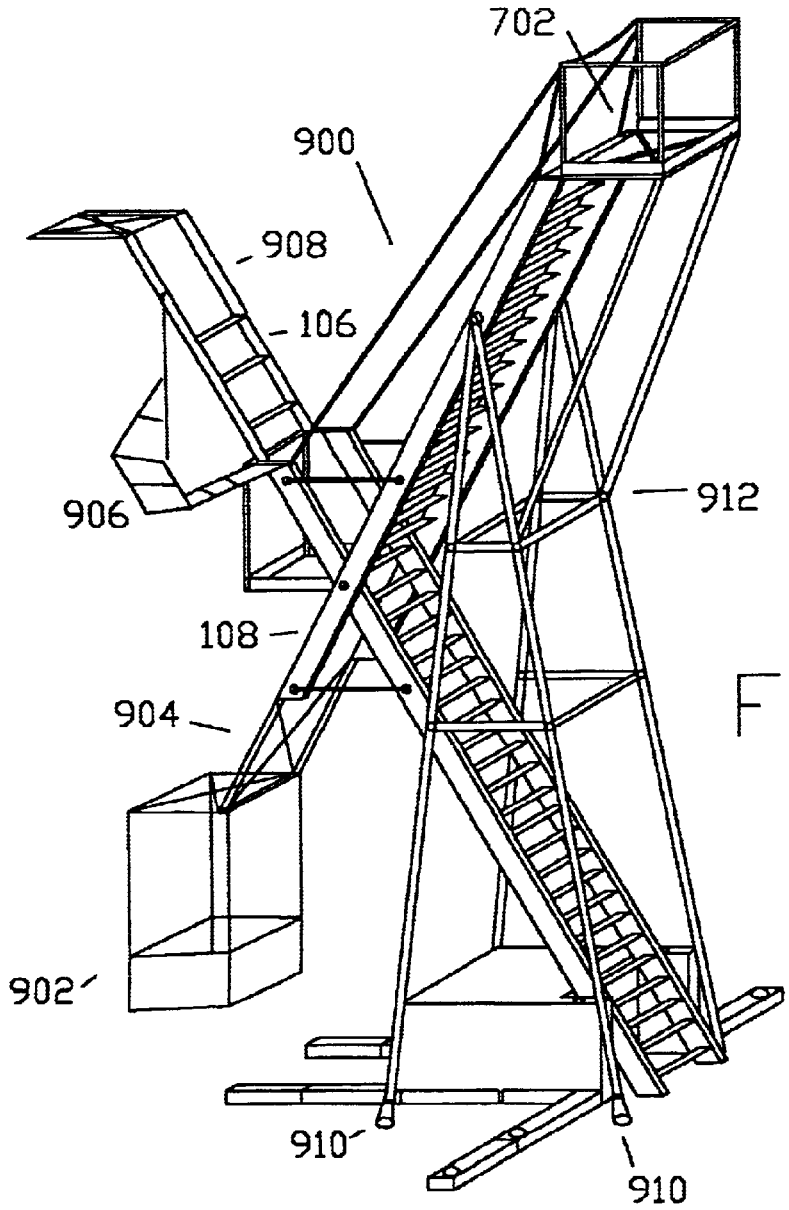
FIG. 9 depicts how several add-on features may be implemented with the extension ladder of FIGS. 7A–7C.

FIG. 9 depicts an embodiment 900 of the extension ladder 700 in FIG. 7A that demonstrates the versatility of the present invention. The extension ladder 900 in the illustrated implementation includes:

- the enclosed platform 702;
- a high chair 902 suspended from a lower leg extension 904 from the upper ladder portion 108; and
- a slide around plank 906 hung from the top end 908 of the lower ladder portion 106.

Note that each of the gin poles 705, in this particular embodiment, includes an extension boot 910 to achieve additional height with the enclosed platform 702. Additional bracing 912 is also included. As will be appreciated by those skilled in the art having the benefit of this disclosure, the need for and the location of such additional bracing will be implementation specific.

Figure 10:
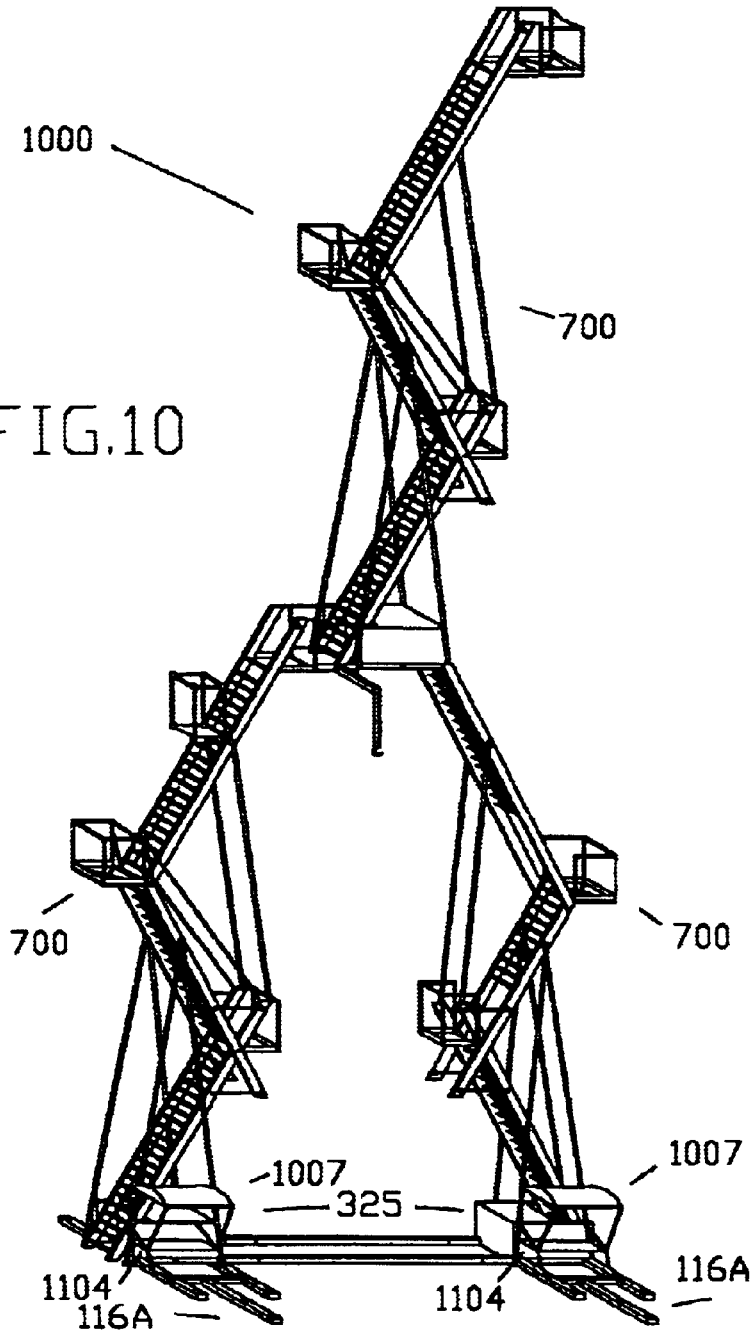
FIG. 10 illustrates an alternative deployment of the extension ladder of FIGS. 7A–7C.

The extension ladders 100, 700 may also be stacked to achieve greater elevation for working platforms. FIG. 10 depicts one such stacked implementation 1000 using three extension ladders 700 first discussed in connection with FIGS. 7A–7C pinned together—two beneath and one atop the two below. The extended reach of this configuration with these dimensions is 100 ft. This configuration will also need an adapted outrigger set-up wherein outriggers 116*a* are pinned together to widen overall stance at its base.

In this particular implementation 1000, the toolbox 325 has a canopy 1002 and fold-down bench 1004 for first-aid, lunch, breaks or getting out of the weather. The toolbox 325 may also have a urinal attachment, oxygen-acetylene tanks with sensor(s), and/or a fork truck attachment. The toolbox 325 may also include a small refrigerator-oven, heater-fan, personal storage area, a cell phone, and/or a computerized sensing system to record work done. In one particular implementation, the computer sensing system disallows unsafe practices outside the design parameters of the extension ladder 700, e.g., unsafe configurations, loads, etc.

Among its many advantages and benefits, the present invention improves safety conditions and costs factors on practically any construction site. The present invention redesigns the way the work is accomplished and eliminates, or at least reduces, numerous known hazards. For instance, there typically will be no heavy equipment, no overhead loads, and no high work outside of a hand rail. The various embodiments also provide tie off without restriction or production loss.

Furthermore, the present invention will reduce the size of the erection crew from six workers to three and reduce the overall construction hazards under which they work. Note, however, that although designed to aid in the construction of commercial warehouse-type buildings, it may be employed in a wide range of environments including, but not limited to, utility work, industrial construction, ironwork, pipefitting, electrical work, etc.

The invention can therefore be used to implement a wide variety of construction tools to streamline and economize construction. For instance, the invention may first be deployed as the crane 400 in FIG. 4. The crane 400 can off-load structural steel (not shown) from trucks (also not shown); load three to five columns and/or beams on each side (while resting vertically on the outriggers); roll over to a work position; and proceed to construct the steel putting up the pieces from one side. Note that, to be unloaded in this manner, the steel must be loaded in a particular order, and turned correctly and in order. Nevertheless, the crane 400 may then roll around 180° to erect the steel on the other side of the work position. This operation would be able to move and erect up to fourteen pieces of steel per trip between the truck and the work position.

More particularly, three pieces may be erected at any given time. First, the columns are set and those two workers proceed up each ladder. The third worker raises the beam for connection, then workers return to ground. The crane 400 moves down the column line erecting four more pieces, two columns, and two beams. It is then able to rotate 180° to erect the steel from the opposite side of the robot and return to the steel pile to reload. The number of pieces of steel loaded will depend upon the weight and/or size of the members.

Once the structural steel is up, the crane 400 may be broken down into two mobile extension ladders 100 so that miscellaneous steel operations and modifications can be performed in two separate locations. The weight of the loaded base 102 acts as a counterweight to stabilize the rest of the extension ladder 100. Since the ladder's base may, in some embodiments, store a worker's tools, this also brings all the tools to the desired location as work progresses. All of the hoses, welding leads, and cords for equipment stored in the base 102 are fixed in place so the worker does not have to roll out or roll up equipment and tools.

Two extension ladders 100 may then even be implemented as the elevator 600 or to hoist materials to the roof of a structure. For the elevator 600, the central elevator frame pins within the top hoist frame and to the inner base of each base 102. The elevator carriage acts as a scissorlift or scaffolding, giving safe access to any variety of elevations. For use in hoisting materials to a roof (not shown). For instance, materials may be unloaded and moved parallel to the side of the building using the crane 400. The outriggers 116 are extended and screwed down. The load is then attached and lifted up the wall to the roof elevation. The outside outrigger 116 may then roll up next to the building wall six inches away, then shift the crane 400 forward four feet, lower the load onto the roof parallel to the load-bearing external wall.

Thus, as set forth above, the invention is able to function as a crane, or as three manlifts, as a scaffold or personnel elevator in various embodiments. The rigging time between the various configurations, e.g., the extension ladder 100, crane 400, and elevator 600, is designed to be minimal, allowing changeover and change-back to be as simple and safe as possible. The invention may also be a "home base" on a construction site, keeping the equipment secure and readily available. It saves time and effort in a variety of ways, allowing fewer men to work smarter, not harder, as well as safer and faster. This results in a lower bid and/or higher profit margins in the construction industry. Still other advantages and benefits may arise from the application of the present invention.

The particular embodiments disclosed above are illustrative only, as the invention may be modified and practiced in different but equivalent manners apparent to those skilled in the art having the benefit of the teachings herein. Furthermore, no limitations are intended to the details of construction or design shown herein, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. An apparatus, comprising:

a base;

a lower ladder portion connected to and extending from the base in a first direction, the lower ladder portion including a plurality of rungs;

an upper ladder portion connected to the lower ladder portion and extending therefrom in a second direction opposite the first direction, the upper ladder portion including an access therethrough from the lower ladder portion, wherein the access is larger than the distance between adjacent rungs and sufficient for a person to pass through; and a support bearing the weight of the upper and lower ladder portions, and of fixing the relative positions of the upper ladder portion, the lower ladder portion, and the base, when the first and second ladder portions are raised and the support is set.

2. The apparatus of claim 1, wherein the base includes a plurality of outriggers extending radially outward.

3. The apparatus of claim 2, wherein the support includes a plurality of guys between at least one of the outriggers and at least one of the tipper ladder portion, and the lower ladder portion.

4. The apparatus of claim 2, wherein the outriggers are capable of articulating to translate the base.

5. The apparatus of claim 2, wherein the base includes a platform to which outriggers are pivotably mounted.

6. The apparatus of claim 1, wherein the lower ladder portion is pivotably connected to the base.

7. The apparatus of claim 1, wherein the base houses at least one of:

an engine capable of moving the ladder; and a hydraulic system capable of lifting at least one of the upper ladder portion and the lower ladder portion.

8. The apparatus of claim 7, wherein the base includes a plurality of outriggers capable of collapsing and telescoping when powered by the engine to translate the base.

9. The apparatus of claim 7, wherein the base includes a plurality of wheels mounted thereto, the wheels being powered by the engine.

10. The apparatus of claim 7, wherein the base includes a housing for the engine and the hydraulic system.

11. The apparatus of claim 7, wherein the hydraulic system powers the support.

12. The apparatus of claim 1, further comprising a plurality of wheels mounted, to the base.

13. The apparatus of claim 12, wherein the wheels are mounted so that they are capable of collapsing into the base..

14. The apparatus of claim 1, wherein the upper and lower ladder portions may be raised and lowered relative to the base.

15. The apparatus of claim 14, wherein the upper and lower ladder portions may be raised and lowered by one of a hand crank and a hydraulic system.

16. The apparatus of claim 1, wherein the access comprises an opening between a first and a second riser of the upper ladder portion.

17. The apparatus of claim 16, wherein the access includes a removable door in the opening between the risers of the upper ladder portion.

18. The apparatus of claim 1, wherein the support includes at least one of a pair of struts, a plurality of guy lines, and a pair of braces.

19. The apparatus of claim 18, wherein the support comprises at least one of:

a plurality of guys extending from the base; and a plurality of pins extending through co-aligned bores.

20. The apparatus of claim 18, wherein the pair of struts comprises a pair of gin poles.

21. The apparatus of claim 1, wherein the base includes a guide constraining the movement of the lower ladder portion about a first and second pair of pivots.

22. The apparatus of claim 1, further comprising:

a second base;

a second lower ladder portion connected to and extending from the second base in the second direction;

a second upper ladder portion pivotably connected to the second lower ladder portion and extending therefrom in the first direction and structurally joined to the first upper ladder portion, the upper ladder portion including a second access therethrough from the second lower ladder portion; and a second support capable of fixing the relative positions of the second upper ladder portion, the second lower ladder portion, and the second base.

23. The apparatus of claim 22, wherein the first and second upper ladder portions are structurally joined by a crane section fastened to the first and second upper ladder portions, the crane section including:

a rail; and a block and tackle capable of traveling the rail.

24. The apparatus of claim 22, further comprising a lift suspended from a brace structurally joining the first and second upper ladder portions.

25. The apparatus of claim 1, wherein the support includes means for supporting the weight of the upper and lower ladder portions and for fixing the relative positions of the upper ladder portion, the lower ladder portion, and the base.

26. An apparatus, comprising:

a base;

a lower ladder portion connected to and extending from the base in a first direction;

an upper ladder portion connected to the lower ladder portion and extending therefrom in a second direction opposite the first direction, the upper ladder portion including a plurality of rungs;

an access through the upper ladder portion from the lower ladder portion, wherein the access is larger than the distance between adjacent rungs and sufficient for a person to pass through; and means for supporting the weight of the upper and lower ladder portions and for fixing the relative positions of the upper ladder portion, the lower ladder portion, and the base.

27. The apparatus of claim 26, wherein the base includes means for stabilizing the apparatus.

28. The apparatus of claim 27, wherein the stabilizing means includes a plurality of outriggers extending radially outward from the base.

29. The apparatus of claim 26, wherein the lower ladder portion is pivotably connected to the base.

30. The apparatus of claim 26, wherein the base houses at least one of:

an engine capable of moving the ladder; and a hydraulic system capable of lifting at least one of the upper ladder portion and the lower ladder portion.

31. The apparatus of claim 26, further comprising a plurality of wheels mounted to the base.

32. The apparatus of claim 26, wherein the upper and lower ladder portions may be raised and lowered relative to the base.

33. The apparatus of claim 32, wherein the upper and lower ladder portions may be raised and lowered by one of a hand crank and a hydraulic system.

34. The apparatus of claim 26, wherein the accessing means comprises an opening between a first and a second riser of the upper ladder portion.

35. The apparatus of claim 26, wherein the accessing means includes a removable door in the opening between the risers of the upper ladder portion.

36. The apparatus of claim 26, wherein the supporting and fixing means includes at least one of a pair of struts, a plurality of guy lines, and a pair of braces.

37. The apparatus of claim 26, wherein the base includes a guide constraining the movement of the lower ladder portion about the first and second pair of pivots.

38. The apparatus of claim 26, further comprising:

a second base;

a second lower ladder portion connected to and extending from the second base in the second direction;

a second upper ladder portion pivotably connected to the second lower ladder portion and extending therefrom in the first direction and structurally joined to the first upper ladder portion, means for accessing the upper ladder portion from the second lower ladder portion; and second means for supporting the weight of and fixing the relative positions of the second upper ladder portion, the second lower ladder portion, and the second base.

39. An apparatus, comprising:

a first base;

a first lower ladder portion connected to and extending from the rim base in a first direction;

a first upper ladder portion connected to the first lower ladder portion and extending therefrom in a second direction opposite the first direction, the first upper ladder portion including a first access therethrough from the first lower ladder portion; and a first support capable of bearing the weight of the first upper and first lower ladder portions, and of fixing the relative positions of the first upper ladder portion, the first lower ladder portion, and the first base;

a second base;

a second lower ladder portion connected to and extending from the second base in the second direction;

a second upper ladder portion pivotably connected to the second lower ladder portion and extending therefrom in the first direction and structurally joined to the first upper ladder portion, the upper ladder portion including a second access therethrough from the second lower ladder portion;

a second support capable of fixing the relative positions of the second upper ladder portion, the second lower ladder portion, and the second base; and a crane section fastened to the first and second upper ladder portions, the crane including:

a rail; and a block and tackle capable of traveling the rail.

40. The apparatus of claim 39, wherein at least one of the first and second bases houses a winch powering the block and tackle.

41. The apparatus of claim 39, wherein the crane section further includes a second and a third block and tackle traversing the rail and a fourth, fifth, and sixth block and tackle traversing a second rail.

42. The apparatus of claim 39, wherein the crane section loads the first and second supports.

43. The apparatus of claim 39, wherein the crane section is suspended from a brace between the first and second upper ladder portions.

44. An apparatus, comprising:

a first base;

a first lower ladder portion connected to and extending from the first base in a first direction;

a first upper ladder portion connected to the first lower ladder portion and extending therefrom in a second direction opposite the first direction;

means for accessing the first upper ladder portion from the first lower ladder portion;

means for supporting the weight of the first upper and first lower ladder portions and for fixing the relative positions of the upper ladder portion, the lower ladder portion, and the base;

a second base;

a second lower ladder portion connected to and extending from the second base in the second direction;

a second upper ladder portion pivotably connected to the second lower ladder portion and extending therefrom in the first direction and structurally joined to the first upper ladder portion, means for accessing the second upper ladder portion from the second lower ladder portion;

second means for supporting the weight of and fixing the relative positions of the at second upper ladder portion, the second lower ladder portion, and the second base; and a crane section fastened to one of the first lower ladder portion, the first upper ladder portion, the second lower ladder portion, and the second upper ladder portion, the crane section including:

a rail; and a block and tackle capable of traveling the rail.

45. The apparatus of claim 44, wherein at least one of the first and second bases houses a winch powering the block and tackle.

46. The apparatus of claim 44, wherein the crane section further includes a second and a third block and tackle traversing the rail and a fourth, fifth, and sixth block and tackle traversing a second rail.

47. The apparatus of claim 44, wherein the crane section loads the first and second supporting and fixing means.

48. The apparatus of claim 44, wherein the crane section is suspended from a brace between the first and second upper ladder portions.

* * * * *